US008199612B2

(12) United States Patent
Jolidon

(10) Patent No.: US 8,199,612 B2
(45) Date of Patent: Jun. 12, 2012

(54) TIMEPIECE WITH VARIABLE HOUR CIRCLE

(75) Inventor: Hugues Jolidon, Courfaivre (CH)

(73) Assignee: Paul Hartzband, Chappaqua, NY (US)

( * ) Notice: Subject to any disclaimer, the term of this patent is extended or adjusted under 35 U.S.C. 154(b) by 115 days.

(21) Appl. No.: 12/600,543

(22) PCT Filed: Apr. 24, 2008

(86) PCT No.: PCT/CH2008/000188

§ 371 (c)(1),
(2), (4) Date: Nov. 17, 2009

(87) PCT Pub. No.: WO2008/144948

PCT Pub. Date: Dec. 4, 2008

(65) Prior Publication Data

US 2011/0069590 A1 Mar. 24, 2011

(51) Int. Cl.
*G04B 19/00* (2006.01)
*G04B 19/16* (2006.01)

(52) U.S. Cl. ..... 368/223; 368/231

(58) Field of Classification Search ..... 368/231, 368/223

See application file for complete search history.

(56) References Cited

U.S. PATENT DOCUMENTS

| | | | | | |
|---|---|---|---|---|---|
| 303,145 | A | * | 8/1884 | Ethridge | 368/231 |
| 319,804 | A | | 6/1885 | Ethridge | |
| 347,337 | A | * | 8/1886 | Ethridge | 368/231 |
| 350,671 | A | * | 10/1886 | Ethridge | 368/231 |
| 374,605 | A | * | 12/1887 | Lewis | 368/231 |
| 393,000 | A | * | 11/1888 | Ethridge | 368/231 |
| 395,696 | A | * | 1/1889 | Ethridge | 368/231 |
| 401,697 | A | | 4/1889 | Ethridge | |
| 403,525 | A | * | 5/1889 | Ethridge | 368/231 |
| 1,581,910 | A | * | 4/1926 | Berrill | 368/27 |
| 1,926,243 | A | * | 9/1933 | Russo | 368/27 |
| 1,974,357 | A | * | 9/1934 | Eklund | 368/27 |
| 3,404,527 | A | * | 10/1968 | Tripet et al. | 368/231 |
| 5,687,140 | A | * | 11/1997 | Sekine et al. | 368/231 |

FOREIGN PATENT DOCUMENTS

| | | |
|---|---|---|
| CH | 684814 | 1/1995 |
| DE | 33129 | 9/1885 |
| FR | 890586 | 2/1944 |
| FR | 2776785 | 10/1999 |
| WO | 9736214 | 10/1997 |

OTHER PUBLICATIONS

International Search Report dated Dec. 4, 2008, in PCT application.

* cited by examiner

*Primary Examiner* — Sean Kayes
(74) *Attorney, Agent, or Firm* — Young & Thompson

(57) ABSTRACT

Timepiece including indicator members actuated or not actuated by the movement. These indicator members are composed of movable hour marks represented by the faces of the studs (30, 40) mounted on staffs having planet wheels (34) driven by a rack (50). The faces of the studs carry stones of various colors. When the movement operates the rack, it determines the change of the hour marks. When operation by the movement is disengaged, manual control elements allow the hour marks appearing on the dial to be changed.

17 Claims, 14 Drawing Sheets

Coupe V-V

Coupe VII-VII

Coupe VI-VI

TIMEPIECE WITH VARIABLE HOUR CIRCLE

STATE OF THE ART

The manufacturers of watches are constantly seeking to vary the appearance of the hour-dial. To this end, numerous suggestions have already been made in order to make the dial and the hour circle look particular and unusual. Furthermore, additional indications related to time are frequently displayed. Thus, display devices indicate the day of the month, the weekday, the moon phases, or the hour over 24 hours. Sometimes the watch has a second hour hand that can be set to any chosen time zone. All these devices are added to improve the time display and make it more attractive. In so-called medium or top of the line watches, these indications are often symbolized by a semi-precious or a precious stone, for example a diamond. All hour indications <<1, 2, . . . , 12>> can be represented materially by such stones, or only a part thereof. In fact, in many watch models, the representation of the hour circle is symbolized by four hour marks, for example by the presence of a diamond at hour points <<12>>, <<3>>, <<6>>, and <<9>>), or by a single diamond at the location of twelve o'clock only.

These indications representing the hour circle are static, and it is understood that the owner of such a timepiece cannot modify their aspect in any case. However, in many situations, it may be interesting to vary these indications through a changeable system.

The references cited hereinafter illustrate the search for attractiveness of the hour display by clockmakers.

Swiss Patent CH 684 814 describes a timepiece with means making it possible to modify the presentation of the hour circle. A rack is arranged to cooperate with a crown and to allow the rotation. Studs which are free to rotate and are provided with satellites engaging with the rack are provided at the location of the hour points. The faces of prisms mounted on these studs are inset with precious stones, the latter appearing through openings made in the middle or the dial.

German Patent DE 33 129 describes a watch dial that allows seeing the twenty-four hours of the day. A window arranged at the location of the hour reference shows a face of a cubic body provided with an axle that is held by bearings. On the faces, the corresponding hours from 1 to 12 and from 13 to 24 are inscribed. The axle carrying this body is provided with pins that are actuated at every turn of the dial by a stem that is itself connected to the axle that moves the hands. During the passage of the hour hand, the visible face of the body turns a quarter turn and changes e.g. from one o'clock to thirteen o'clock.

French Patent 2 776 785 describes an assembly that constitutes the exterior of a watch and comprises a watch casing and a strap provided with a clasp for connecting it to the casing and a movable element having four decorative faces that is pivotably mounted on one of the two parts. The part comprising the movable element is provided with a cutout that lets appear one of its faces. Clamping the mobile organ in either one of its positions is achieved by fixing the strap to the casing.

BRIEF SUMMARY OF THE INVENTION

With regard to this prior art, important further developments have been conceived to vary the hour circle:

The actuation by the movement of the watch, in a disconnectable manner and allowing functions such as the indication of day/night by changing the visible face of the hours;

The actuation by a quartz movement, through a specific rotor and in a disconnectable manner;

To this end, the present invention suggests a timepiece according to claim 1.

BRIEF DESCRIPTION OF THE DRAWINGS

Hereinafter, several embodiments of the invention that have been chosen in a non-limiting manner will be described with reference to the accompanying drawings.

DETAILED DESCRIPTION OF THE INVENTION

Figure 1:
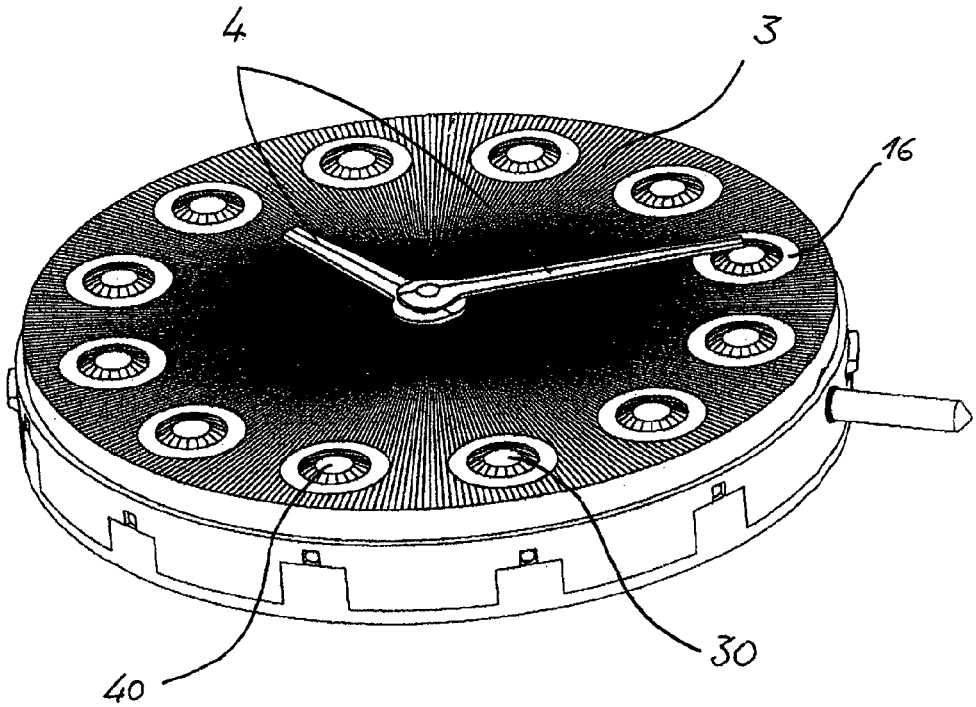
FIG. 1 is a 3D view illustrating the appearance of a watch according to the invention without the case.

FIG. 1 shows the appearance of a watch having a variable hour circle. Dial 3 and hands 4 seem to be conventional. However, dial 3 is pierced with twelve apertures 16 at the location of every hour to let the stones appear which are mounted on studs 30, 40.

Figure 2:
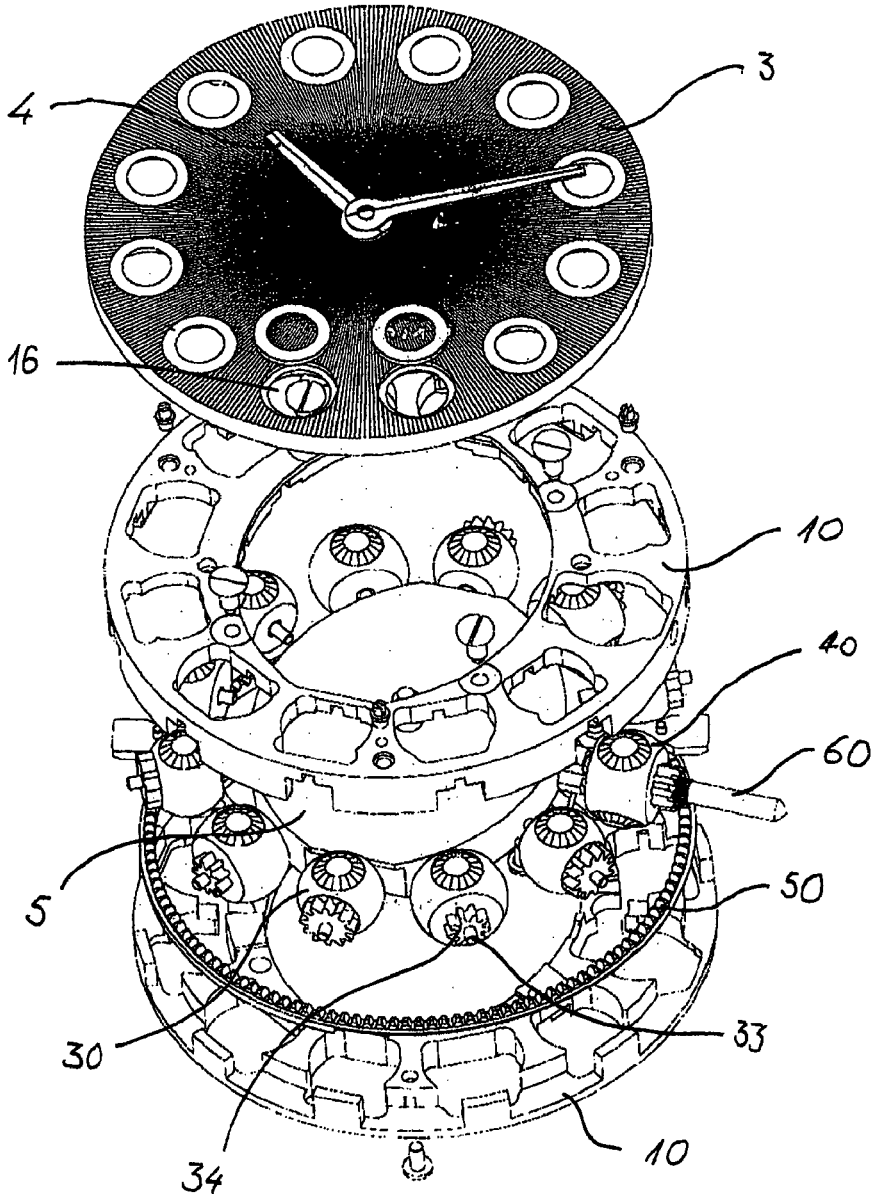
FIG. 2 is an exploded view of the watch according to one embodiment.

FIG. 2 depicts the mechanism of the variable hour circle according to one particular embodiment. Two-part middle 10, provided with the required millings and cutouts, holds rack 50 and the twelve studs 30, 40 that are each provided with an axle 33 allowing their rotation and with a satellite 34 allowing their actuation.

Figure 3:
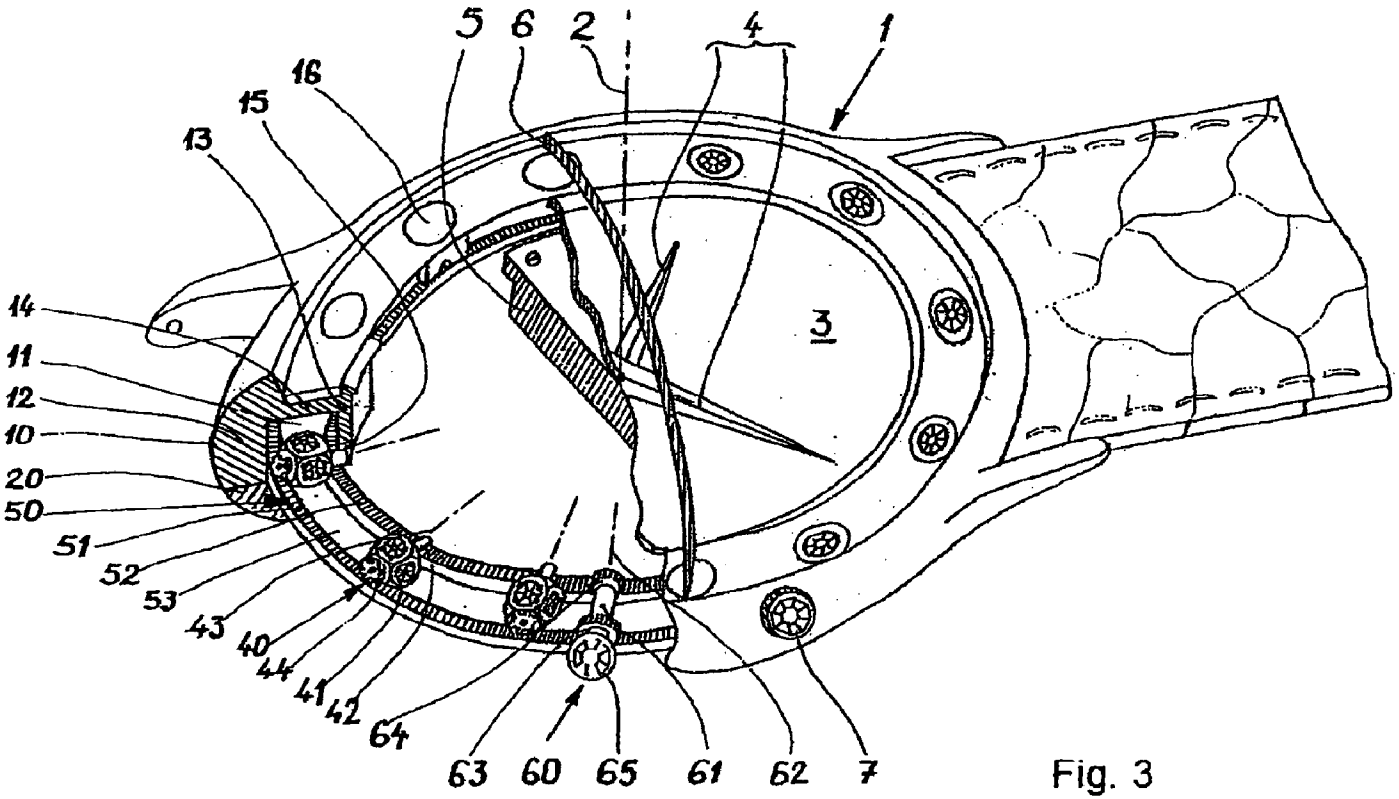
FIG. 3 is a partly exploded perspective view depicting the prior art.

FIG. 3 describes the prior art disclosed in Patent CH 684 814. The figure shows a wristwatch 1 composed of a case formed of a middle 10 and a back 20 containing a dial 3, hands 4, a movement 5, a glass 6, and a crown 7. An actuating device 60 drives circular rack 50. Studs 30, 40 integral with satellites 34, 44 are driven by rack 50. A precious stone 35A . . . 48A is mounted on each face of studs 30, 40. Apertures 16 in dial 3 allow the stones to be seen. By actuating device 60, different stones appear in apertures 16. Due to the fact that studs 30, 40 may have three or four faces and satellites 34, 44 may have nine or twelve teeth, the arrangement of the stones visible according to the hours in function of the rotation of rack 50 comprises twelve possibilities.

Figure 4B:
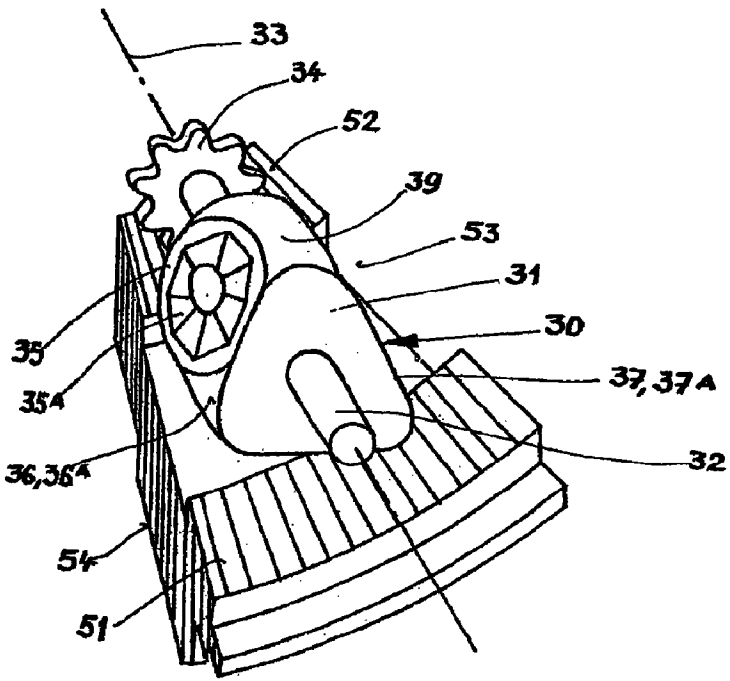
FIGS. 4A and 4B illustrate examples of rotatable studs provided with stones, which are meshing with a rack.
Figure 4A:
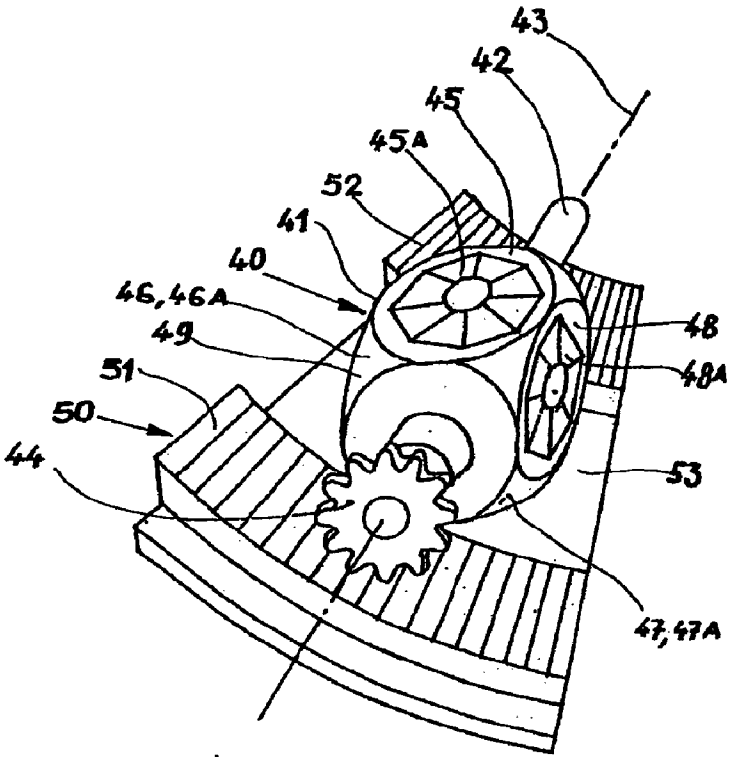

FIGS. 4A and 4B show the operation of the studs in detail. Stud 40 is visible in FIG. 4A with its pin 42 of axis 43, its satellite 44, and its cube 41 mounted on pin 42. The edges and particularly corners 49 are rounded in order to be able to arrange the stud as close as possible to portion 14 of middle 10, i.e. to aperture 16. In fact, the curvature of the edges obtained by rounding the corners avoids that cube 41 conflicts with portion 14 in the vicinity of aperture 16 during its rotation. In face 45 of cube 41, e.g. a diamond 45A is inserted or set. In adjacent face 46, a ruby 46A is inserted. In face 47 opposite face 45, an emerald 47A is inserted. In face 48, adjacent to face 45 and opposite face 46, a sapphire 48A is inserted. As mentioned above, satellite 44 cooperates with tooth array 51 of rack 50. In the example illustrated in FIG. 4A, satellite 44 has twelve teeth.

FIG. 4B shows another example of a stud of global reference 30 that is not shown in the exemplary arrangement of FIG. 3. This stud has a pin 32 of axis 33. It is freely rotatable about this axis. The body of stud 30 has the shape of a triangular straight prism 31 whose edges 39 are curved for the same reasons as already explained in the preceding paragraph with regard to stud 40. The three faces, which are parallel to axis 33, are designated by reference numerals 35, 36, 37. These faces are e.g. provided with a diamond 35A, a ruby 36A, and an emerald 37A, respectively. A satellite 34 cooperates with tooth array 52 of rack 50. In the illustrated example, satellite 34 has nine teeth.

Figure 5A:
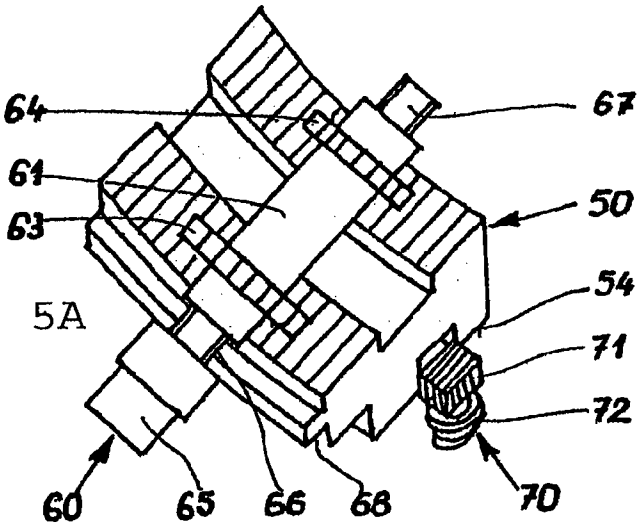
FIGS. 5A, 5B, and 5C illustrate means for actuating the rack or racks.

FIG. 5A shows the actuating device 60 of rack 50 and a pressure or brake device 70. The actuating device is guided in middle 10 by means of bores that are adapted to the dimensions of portions 66, 67 of stem 61 and support this part. The gear characteristics of toothed driving wheels 63, 64 are adapted to those of tooth array 51, 52 of rack 50 (same module and correspondence of the pitch diameters or pitch lines). The rack further has a stepped profile 68 that cooperates with a corresponding guide profile (not shown) performed in back 20.

At least one brake device 70 is provided. This device consists of a plate 71, e.g. of glass, and of a spring 72 arranged in a cavity made in back 20, such that a force is applied to the rack by said spring through plate 71. This device has a double function: on one hand, to prevent any involuntary rotation of the rack, e.g. due to wrist movements, and on the other hand, to allow an easy and continuous rotation through actuation of crown 65. Preferably, two devices will be provided which are diametrically opposed to one another.

Figure 5C:
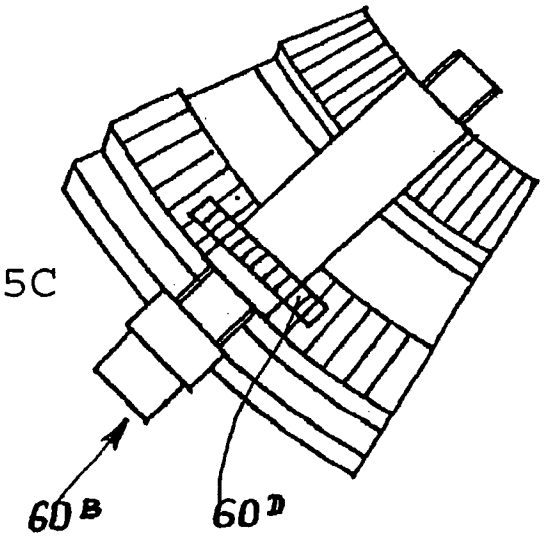
Figure 5B:
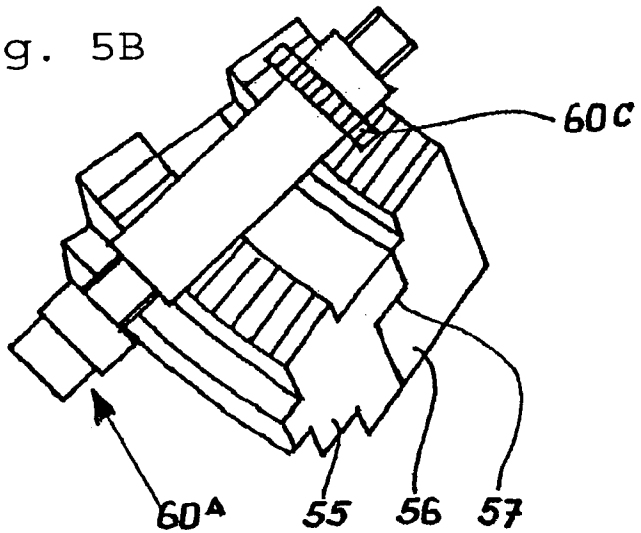

FIGS. 5B and 5C show an embodiment variant in which the rack is formed of two independent parts 55, 56. Exterior rack 55 is actuated by a device 60B whose single toothed driving wheel 60D is meshing with the tooth array of part 55. Interior rack 56 in turn is meshing with single toothed driving wheel 60C of device 60A. The fit of the surfaces carrying the global reference 57 is such that there is no friction between the two racks, thereby preventing that the rotation of one rack causes an involuntary rotation of the other one. The other characteristics are similar to those of device 60.

Figure 6:
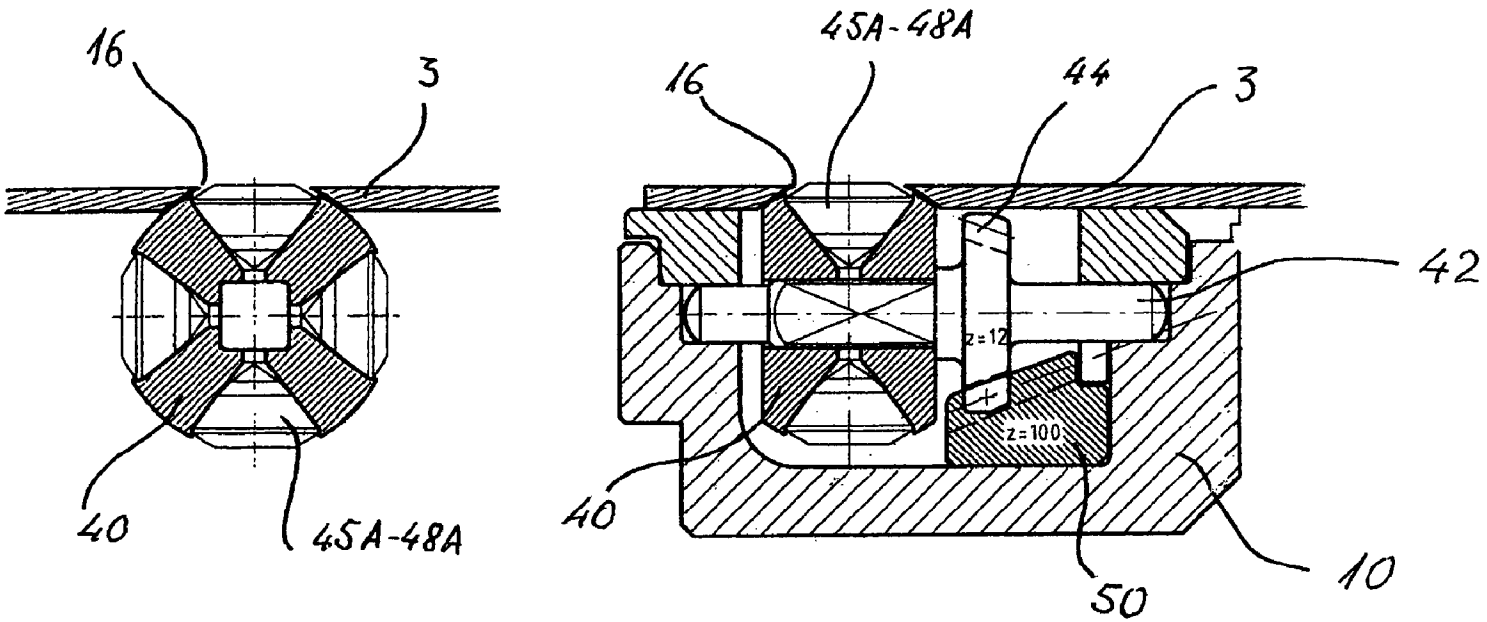
FIGS. 6 and 7 illustrate another solution for the variation of the rotation speed of the studs.
Figure 7:
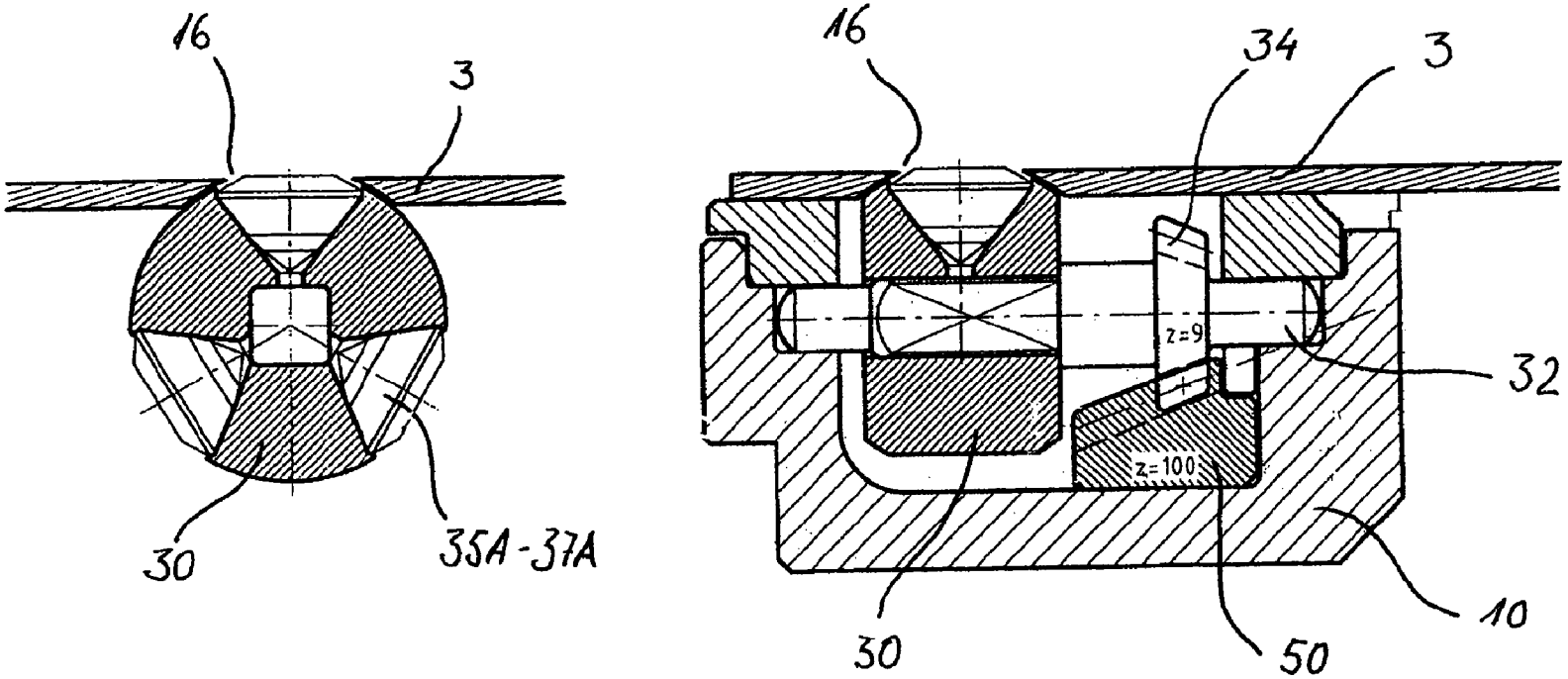

FIGS. 6 and 7 illustrate another solution for allowing the variation of the rotation speed of the studs. To drive triangular studs 30 and cubic studs 40 by means of the same rack 50, a conical tooth array is used. Thus, satellite 34 of smaller diameter is placed on the highest portion of rack 50 while satellite 44 having a larger diameter is placed on the lowest portion.

Figure 8:
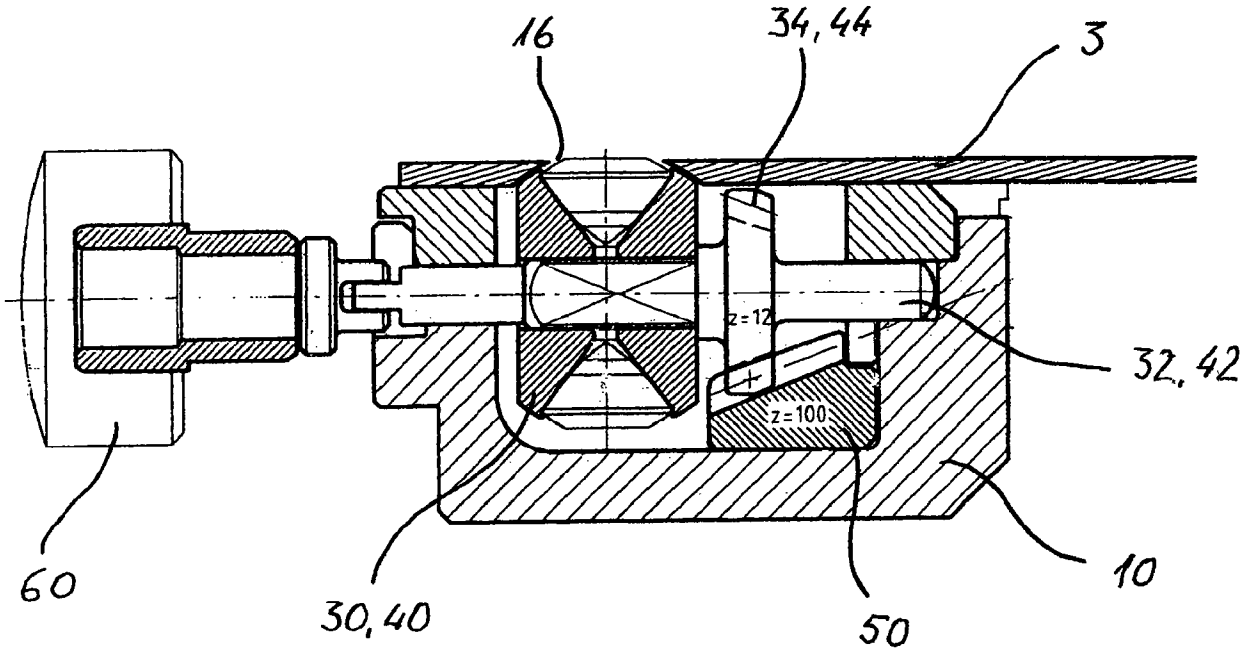
FIG. 8 shows the crown that rotates the studs.

FIG. 8 indicates an advantageous possibility of arranging crown 65 in direct engagement with a stud stem 32, 42 to drive a satellite 34, 44, thereby causing the rotation of rack 50 and of the other eleven studs connected to rack 50 via their respective satellites.

Figure 9:
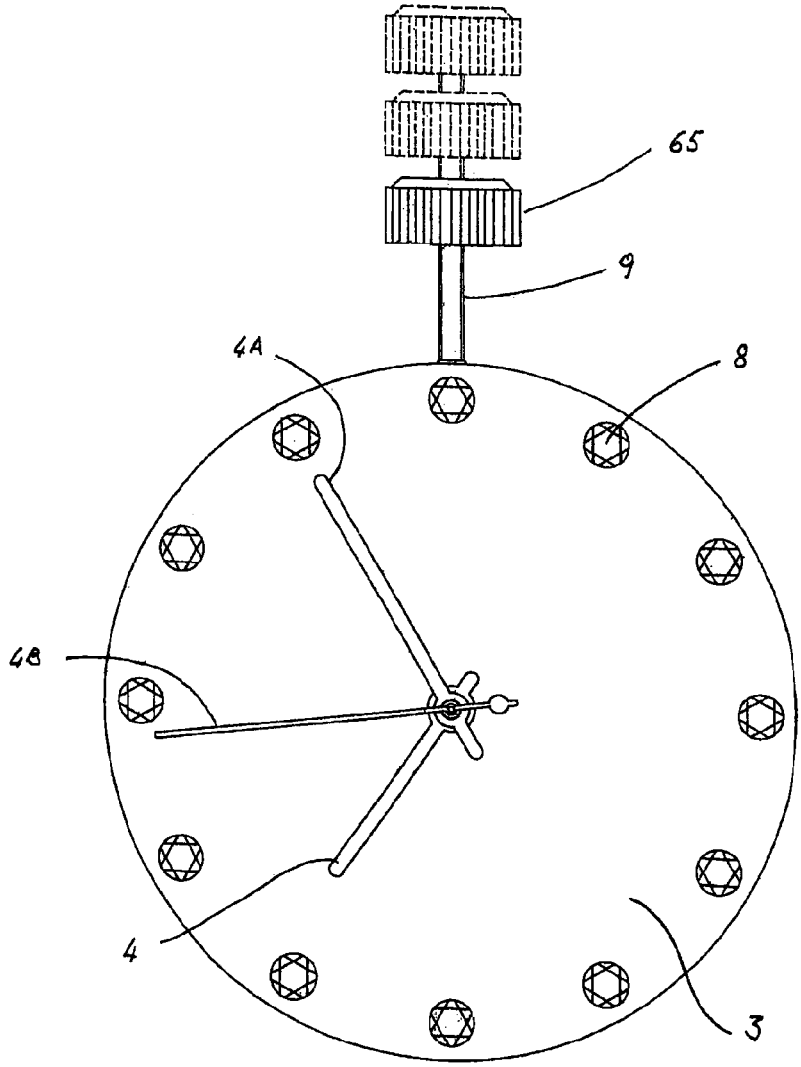
FIG. 9 is a schematic view of the visible side of a wristwatch according to the invention.

As appears in FIG. 9, the watch of the invention comprises the elements of a usual wristwatch. The case of this watch is not illustrated. It may be of a usual construction. Dial 3 is provided with twelve hour signs 8 that are distributed on its rim and have the appearance of stones. Hour hands 4, minute hands 4A and second hands 4B turn above dial 3. A setting stem 9 carrying a crown 65 passes through the wall of the case. This stem 9 actuates a setting mechanism by the axial movement of crown 65, which may take three different positions: A: pushed-in position, B: intermediate position and C: outer position.

Figure 10:
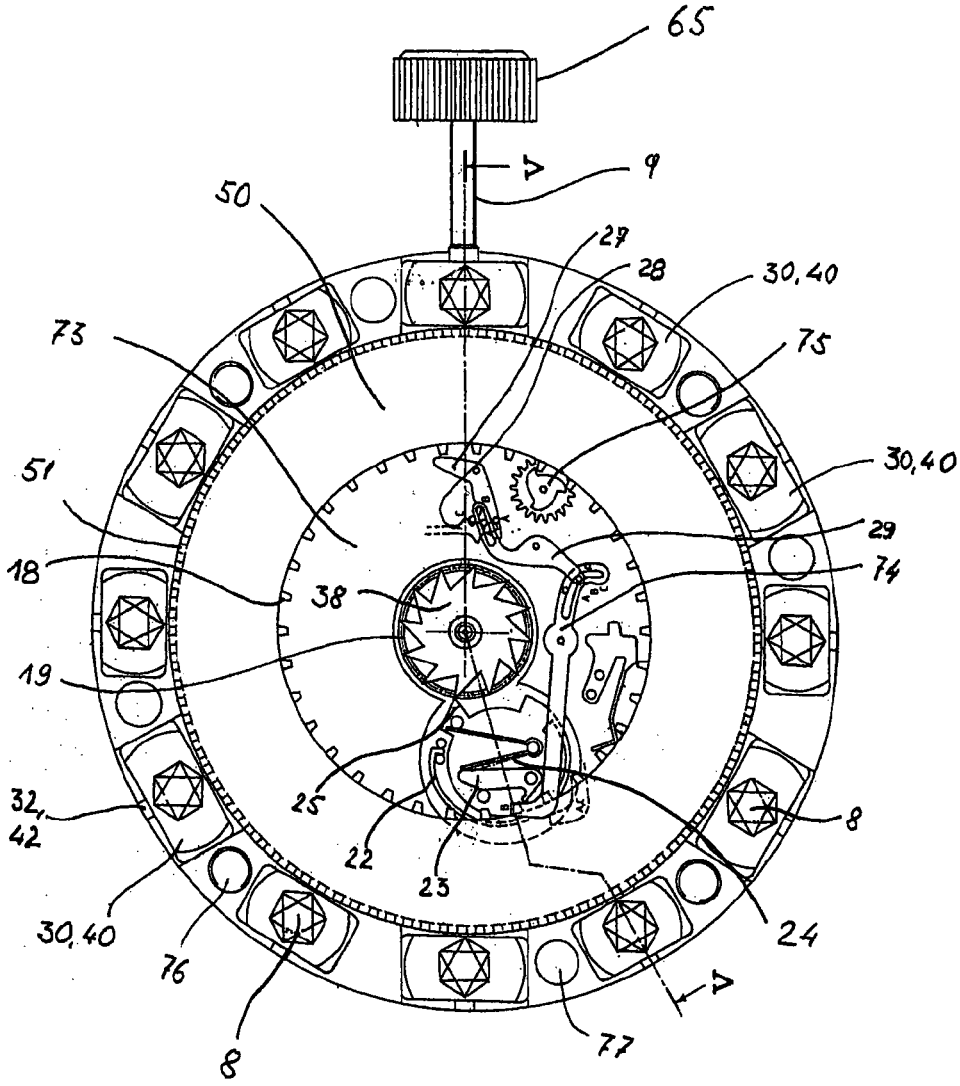
FIG. 10 is a plan view of the upper surface of the movement of this watch which illustrates a position of the actuating mechanism of the automatic actuation.

In FIG. 10, dial 3 has been removed, and stem 9 and setting crown 65 are placed in their middle positions so that different mechanisms accommodated under the dial are visible. In fact, hour signs 8 are decorations that are provided on studs 30, 40 of cylindrical or prismatic shape with convex lateral faces, which are distributed around the movement and rotatable about radial axes.

Figure 13:
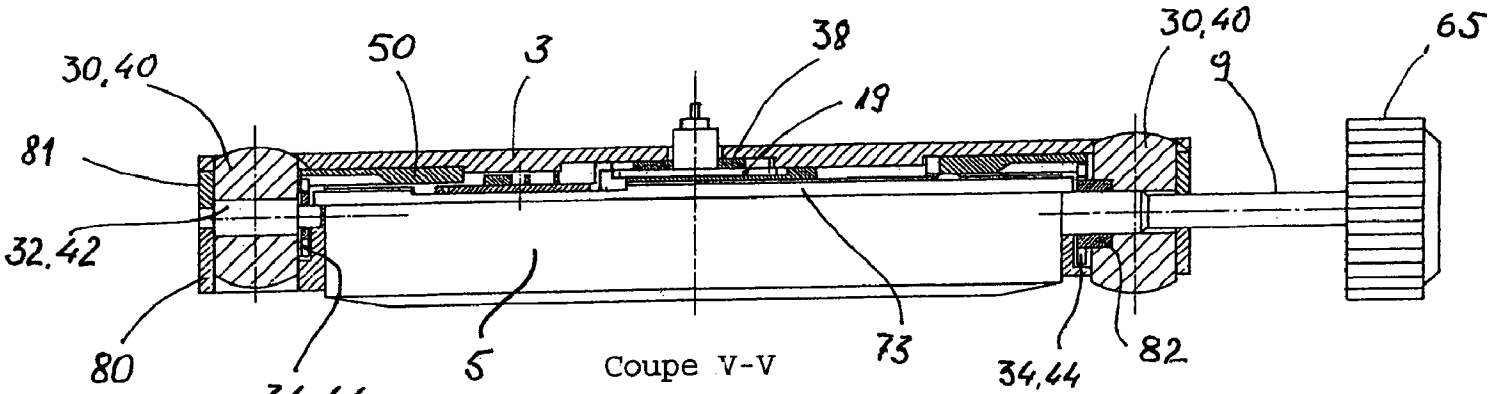
FIGS. 13, 14, and 15 are sectional views according to lines V-V, VI-VI, and VII-VII in FIGS. 10 and 12.

FIG. 13 shows that movement 5 of the described watch is enclosed in a circular cage that is formed of two portions: a lower casing ring 80 and an upper casing ring 81, and that studs 30, 40 are mounted on stems 32, 42 whose ends pivot in grooves made in rings 80 and 81. Stud 30, 40 directed to three o'clock turns on stem 9. It is mounted on a sleeve 82 that turns on stem 9. Like stems 32, 42, this sleeve 82 is connected to a satellite 34, 44. The axes 33, 43 of stems 32, 42 located at 2/4/6/8/10 and 12 o'clock are slightly closer to the surface of plate 73 than the axes of the other stems, the latter being at the same height as the axis of setting stem 9. These differences in height between the axes of satellites 34, 44 are also visible in FIG. 16. A circular rack 50 (FIG. 13) that is coaxial to the movement is arranged on plate 73. At its periphery, this rack 50 is provided with a tooth array 51 whose teeth project downwards and mesh with satellites 34, 44. The diameters of the latter are of course selected such that their teeth likewise mesh with tooth array 51. This arrangement allows providing the different studs 30, 40 with adapted specifications and making them turn at different speeds, as has been described in patent CH 684 814 already.

Figure 11:
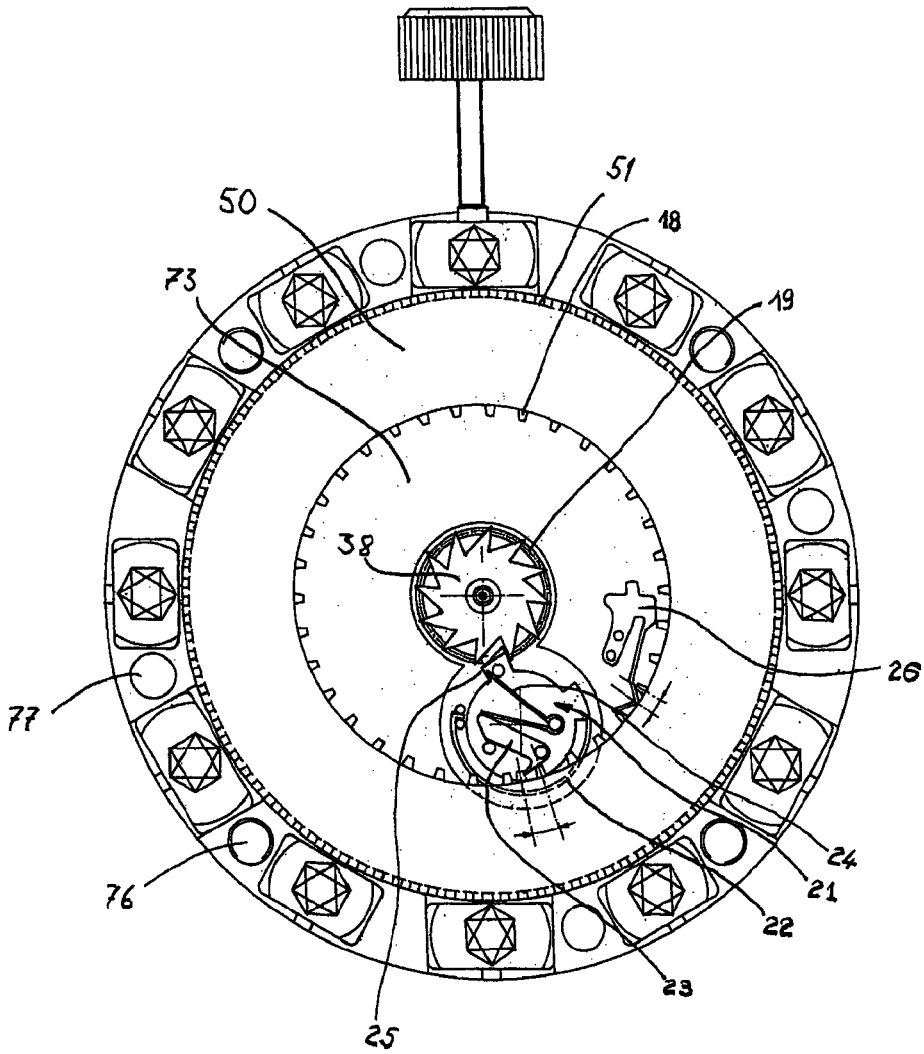
FIG. 11 is a view illustrating the automatic actuating device.

At its inner edge, rack 50 has another tooth array 18 of spaced teeth that are directed radially. Hour wheel 19, which is a usual element of movement 5, in turn carries a star wheel 38 having twelve teeth. The latter cooperate with a pawl wheel 21 that is accommodated in a circular recess of plate 73. This wheel 21 is made with an arched elastic arm 22 whose free end is hooked between two posts that are inserted in the bottom of the recess. Pawl wheel 21 further carries a pawl 23 that pivots on a post which is connected to the plate of wheel 21. Pawl 23 is under the action of a spring wire 24 bearing against a second post, and its rotation is limited by a third post. FIG. 10, compared to FIGS. 11 and 12 and independently from the actuating mechanism that will be explained later on, shows how pawl wheel 21 operates. It has a radial finger 25 that gets in the way of the triangular teeth of wheel 38. In FIG. 10, this finger is about to be liberated. Elastic arm 22 is wound to the maximum and acts upon star wheel 38. In FIG. 11, the finger of pawl 23 engages a tooth of tooth array 18 and moves rack 50 forward until the tip of jumper 26 has passed the tooth on which this jumper is pressing. From this moment on, it is jumper 26 that brings rack 50 to its final position. In this manner, every hour, rack 50 advances by an angle that is equal to the sum of the angles marked by double arrows in FIG. 11. All studs 30, 40 turn by an angle that is determined by the modules of tooth arrays 51 and satellites 34, 44. Since studs 30, 40 may be prisms having a different number of faces and may carry decorations on their faces which represent hour signs 8 having different appearances 35A, 45A, an hour circle is thus obtained whose appearance changes every hour. By combining the number of teeth of the tooth arrays and the number of faces of the studs, simple or complex cyclic variations can be realized.

In FIG. 10, an actuating mechanism that adds other possibilities of animations of the studs is illustrated in part. It is composed of parts that are those of a usual mechanism. Thus, stem 9 acts upon a setting lever 27 whose positions are set by a setting lever jumper spring 28. A linkage cooperates with setting lever 27. It is composed of a rocking lever 29 and of an angled lever 74 whose curved free end may engage in front of the nose of pawl 23 and keep it from actuating tooth array 18 during the alternating rotation of pawl wheel 21. FIG. 13 shows that linkage 29, 74 is located in a cavity of dial 3.

Figure 12:
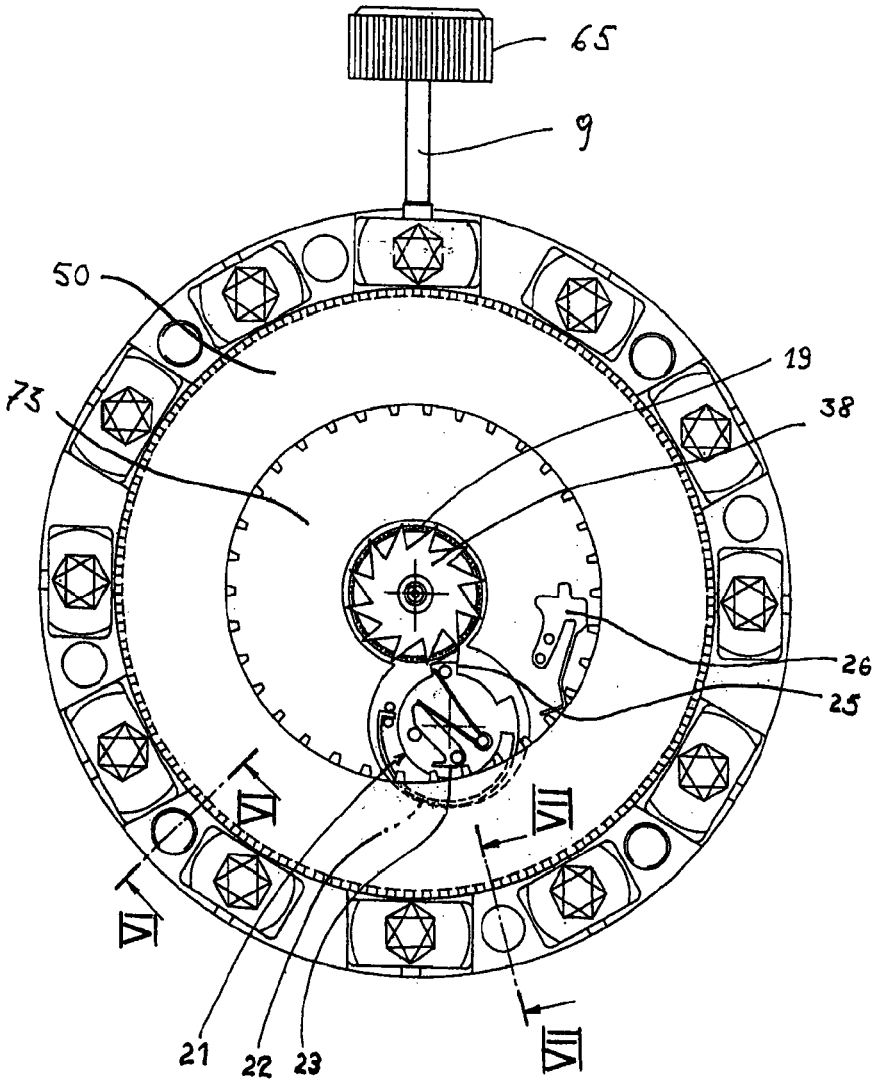
FIG. 12 is a view describing the hour setting operation.

The position of the mechanism as shown in solid lines in FIG. 10 is an intermediate position designated by (B). However, the movement of crown 65 to its pushed-in position (A) and the movement to its outer position (C) both bring lever 74 to the position shown in dotted lines in FIG. 10 due to the curvature of its slotted rear part. Pawl 23 may actuate rack 50 when wheel 21 returns to its unwound position, as seen above. Furthermore, in one position of the mechanism, preferably in the intermediate position (B), a setting wheel 75 comprising a star having three teeth at its upper level and a tooth array at its lower level is connected to stem 9 in such a manner that the rotation of the latter rapidly displaces rack 50, thereby allowing to set a particular constellation of the different faces of studs 30, 40 as desired. Finally, FIG. 12 shows how the mechanism behaves during hand setting. While hour wheel 19, 38 is actuated in the counterclockwise direction, nose 25 of wheel 21 is moved to the right and bends elastic arm 22 outwards without pawl 23 acting on rack 50.

Figure 15:
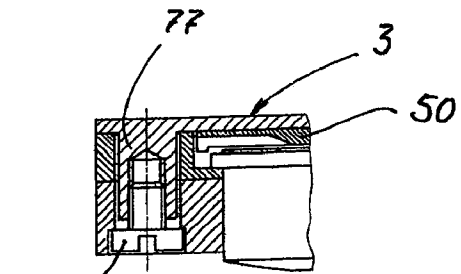
Figure 14:
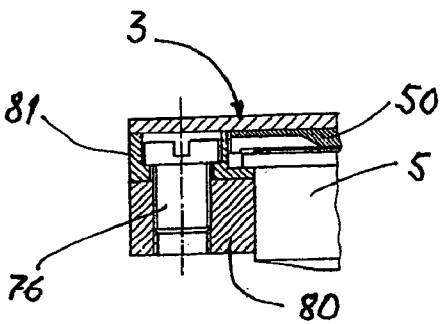

Casing rings 80 and 81 are fastened to each other by ring screws 76, and dial 3 is fastened by its feet 78 and by dial screws 78 to assembly 80, 81 (FIGS. 12, 14 and 15). As the dial has to be fastened so as to secure the positions of various functional members, four feet 77 with dial screws 78 are provided and four ring screws 76 for the rigidity of the fitting circle.

Figure 16:
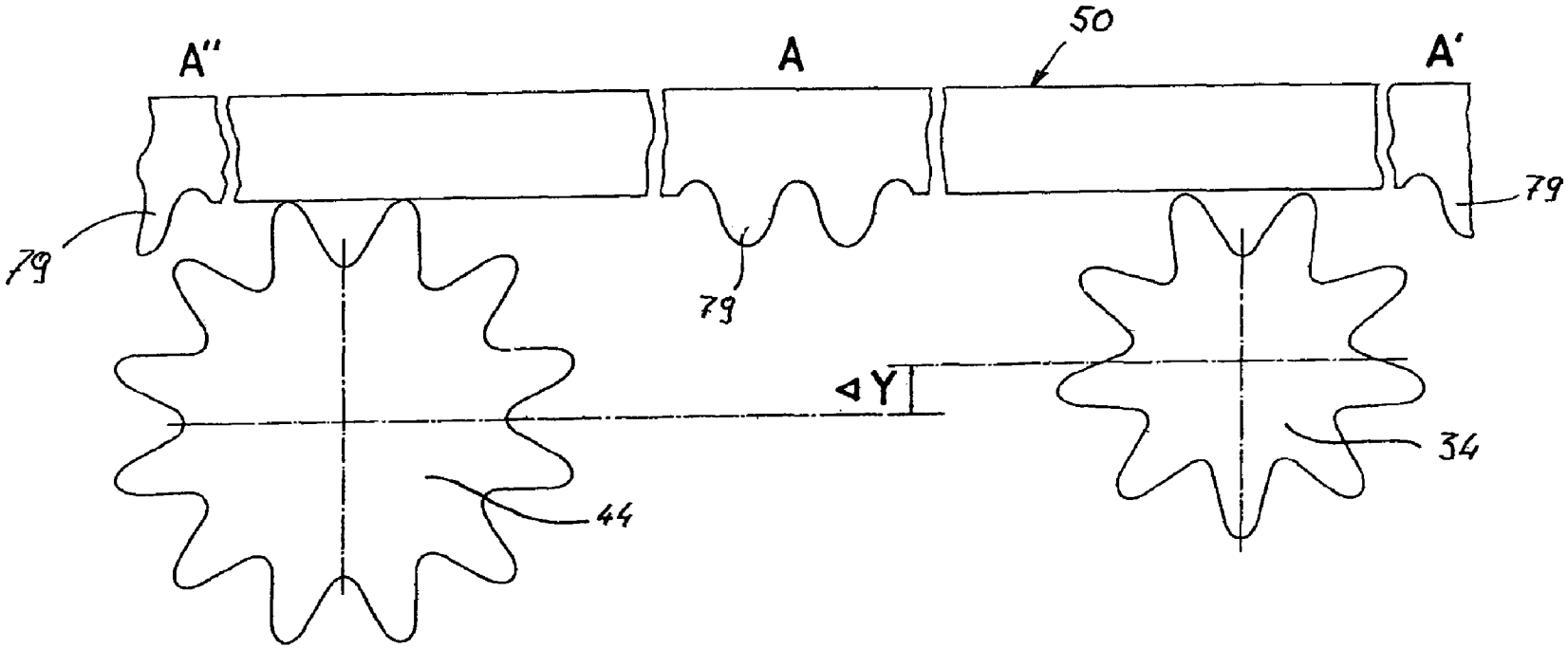
FIG. 16 is a partial development of a particular application of the actuating mechanism of the hour signs.

In the previously described construction, due to the fact that tooth array 51 of rack 50 is continuous on its entire rim, all studs 30, 40 are actuated every hour when the mechanism is in the activated position, i.e. when stem 9 is in the pushed-in position (A). However, it is possible to conceive a different operation. Thus, FIG. 16 shows an embodiment variant of the tooth array of rack 50 with several toothed sectors 79 of a short length that are distributed in locations A, A', A" along the rack. Each sector 79 may mesh both with a satellite having nine teeth 34 and a satellite 44 having 12 teeth. This arrangement allows providing numerous variations. For example, if tooth array 51 comprises only one toothed sector whose length covers the space occupied by two successive studs 30, 40, every hour, a stud will turn from its visible face to the adjacent face and the preceding one from that to the following one. If studs 40 have four faces carrying successive white, black, white, and red signs, for example, every stud 40 will successively become black and then white in twelve hours of operation, thereby simulating the displacement of an hour hand on the dial. In the next twelve hours, every stud will become red and then white, thereby also simulating the displacement of an hour hand, however in such a manner as to indicate the hours of the night. This arrangement may be equivalent to the indication of the hour in a different time zone than that for which the regular hour hand 4 (FIG. 9) is set. This use is only an example, and other arrangements and other uses may be implemented with the described means and without leaving the scope of the invention. In particular, the watch movement might not be mechanical but a quartz movement to which an additional module for actuating the crown is coupled and which comprises specific control means that are apparent to one skilled in the art.

NOMENCLATURE

1. Wristwatch
2. Vertical axis of the watch
3. Dial
4. Hands
5. Movement
6. Glass
7. Hand setting device
8. Hour sign
9. Setting stem
10. Middle
11. Recess
12. Exterior portion of middle
13. Interior portion of middle
14. Upper portion of middle
15. Bore
16. Aperture
17.
18. Radial tooth array
19. Hour wheel
20. Back
21. Pawl wheel
22. Elastic arm
23. Pawl
24. Spring wire
25. Radial finger
26. Jumper
27. Setting lever
28. Setting lever jumper spring
29. Rocking lever
30. Triangular stud
31. Triangular body of stud
32. Stud stem
33. Stud axis
34. Satellite having 9 teeth
35. $1^{st}$ face of triangular stud
35 A Diamond
36. $2^{nd}$ face of triangular stud
36 A Ruby
37. $3^{rd}$ face of triangular stud
37 A Emerald
38. Star wheel having twelve teeth
39. Edge of triangular stud
40. Square stud
41. Square body of stud
42. Stud stem
43. Stud axis
44. Satellite having 12 teeth
45. $1^{st}$ face of square stud
45 A Diamond
46. $2^{nd}$ face of square stud
46 A Ruby
47. $3^{rd}$ face of square stud
47 A Emerald
48. $4^{th}$ face of square stud
48 A Sapphire
49. Edge of square stud
50. Circular rack
51. First tooth array of rack
52. Second tooth array of rack
53. Recess between tooth arrays

54. Base surface of rack
55. Exterior rack
56. Interior rack
57. Opposite faces of racks
58.
59.
60. Actuating device of rack
60 A Actuating device of interior rack
60 B Actuating device of exterior rack
60 C Driving wheel of interior rack
60 D Driving wheel of exterior rack
61. Stem
62. Axis
63. $1^{st}$ toothed driving wheel
64. $2^{nd}$ toothed driving wheel
65. Crown
66. $1^{st}$ journal of stem 61
67. $2^{nd}$ journal of stem 61
68. Stepped profile of rack
69.
70. Brake
71. Plate
72. Spring
73. Mainplate
74. Angled lever
75. Setting wheel
76. Ring screw
77. Dial foot
78. Dial screw
79. Toothed sector of rack
80. Lower casing ring
81. Upper casing ring
82. Setting stem sleeve

What is claimed is:

1. A timepiece comprising, in a case,
a watch movement,
a dial which is visible through a glass which is part of the case,
indicating members actuated by the movement and cooperating with hour signs extending through respective apertures in the dial to allow reading of the time, said hour signs being mounted in rotation in reference to the dial and capable of having different appearances,
first means which are accessible from the exterior of the case and include organs that allow manually modifying the appearance of the hour signs,
second means to automatically modify the appearance of the hour signs by the movement,
wherein said first means are arranged so as to modify the appearance of the hour signs independently of the indicating members and in that said second means comprise an intermittent connection.

2. The timepiece of claim 1, comprising means for adjusting the position of the indicating members, wherein said intermittent connection and said adjustment means are arranged so as to modify the position of the indicating members independently of the appearance of the hour signs.

3. The timepiece of claim 2, in which the appearance of the hour signs is modified via a rack, wherein said intermittent connection comprises
a wheel kinematically integral with at least one of the indicating members and which can be driven manually by said adjustment means, when said wheel turns in a first direction,
a connecting organ inserted between said wheel and the rack,
said wheel and the connecting organ being arranged such that said wheel is not kinematically connected to the rack when it turns in another direction through the actuation of the adjustment means.

4. The timepiece of claim 3, assuming the form of a watch with a hand setting mechanism with a sliding pinion and a setting lever, and wherein the connecting organ comprises a spring pawl mounted on a pawl wheel which is intermittently driven back and forth by said wheel, the latter part only driving the pawl wheel in one direction.

5. The timepiece of claim 1, comprising a device connected to said first means, said device can occupy at least one state in which it makes said intermittent connection inactive, and wherein said first means can occupy at least one position in which they cooperate with said device to bring it into said state.

6. The timepiece of claim 5, in which the appearance of the hour signs is modified via a rack, said timepiece comprising, in addition to second means for automatically modifying the appearance of the hour signs via the movement, a secondary part of the mechanism actuating the rack through the first means without acting on the indicating members, and wherein said secondary part of the mechanism can be actuated when said device is in said state.

7. The timepiece of claim 5, assuming the form of a watch with a hand setting mechanism with a sliding pinion and a setting lever, and wherein the connecting organ comprises a spring pawl mounted on a pawl wheel which is intermittently driven back and forth by said wheel, the latter part only driving the pawl wheel in one direction.

8. A timepiece according to claim 7, wherein said setting lever is actuated by a setting stem of the adjustment means and wherein said device comprises an angled lever one end of which maintains the spring pawl in a deactivated position when the setting stem of the adjustment means is in an intermediate position (B).

9. The timepiece of claim 8, wherein said first means and said adjustment means are actuated by a same crown which can occupy several axial positions (A, B, C).

10. The timepiece of claim 9, wherein in one of said axial positions of the crown, said first means are independent of the hand setting mechanism and allow actuation of said rack manually as desired.

11. The timepiece of claim 8, wherein said first means are independent of the hand setting mechanism and allow actuation of said rack manually as desired.

12. The timepiece of claim 1, wherein the hour signs are studs having a plurality of faces, mounted on stems arranged radially in relation to the movement, each stem being provided with a satellite whereof the tooth array meshes in a rack, and wherein this tooth array is provided along its rim with at least one sector which is interrupted so as to allow a selective actuation of the studs.

13. The timepiece of claim 12, wherein the rack is conical, as are the associated satellites, which makes it possible to vary the number of teeth of said satellites and thus to make said studs turn more or less rapidly.

14. The timepiece of claim 13, wherein interrupted sectors of said tooth array are arranged so as to ensure that in an automatic operating phase, successive studs arranged on the rim of the dial move from a position which results in a first appearance thereof to another position which results in a second appearance at predetermined intervals and then return to a position which results in the first appearance either individually or all together, thereby reproducing a time indicator member.

15. The timepiece according to claim 13, comprising twelve studs whose faces are elements having two positions, preferably carrying stones or characteristic symbols, said studs being connected to the movement so as to change twice in 24 hours, thereby indicating day and night.

16. The timepiece of claim 1, wherein the hour signs, said second means and the organs allowing one to manually modify the appearance of the hour signs are carried by an additional module, mounted on said movement, said first means being kinematically connected to said movement.

17. The timepiece of claim 1, wherein the watch movement is a quartz movement to which is coupled an additional module for automatic driving of the hour signs, provided with a specific, disconnectable rotor, said first means being arranged in the module.

* * * * *